US005578789A

United States Patent [19]

Oberth

[11] Patent Number: 5,578,789

[45] Date of Patent: Nov. 26, 1996

[54] ENERGETIC PLASTICIZERS FOR POLYBUTADIENE-TYPE SOLID PROPELLANT BINDERS

[75] Inventor: Adolf E. Oberth, Fair Oaks, Calif.

[73] Assignee: Aerojet General, Rancho Cordova, Calif.

[21] Appl. No.: 878,222

[22] Filed: May 4, 1992

[51] Int. Cl.[6] ..... C06B 45/10

[52] U.S. Cl. ..... 149/19.9; 149/19.4; 149/88

[58] Field of Search ..... 149/19.4, 19.8, 149/88, 19.9

[56] References Cited

U.S. PATENT DOCUMENTS

| | | | |
|---|---|---|---|
| 3,501,357 | 3/1970 | Suzuki et al. | 149/19.9 |
| 3,684,595 | 8/1972 | Craig et al. | 149/88 |
| 3,692,598 | 9/1972 | Thompson | 149/19.9 |
| 3,695,952 | 10/1972 | Allen | 149/19.9 |
| 3,888,707 | 6/1975 | Rothenstein | 149/19.4 |
| 4,011,818 | 3/1977 | Stosz et al. | 149/19.9 |
| 4,158,583 | 6/1979 | Frosch | 149/19.4 |
| 4,289,551 | 9/1981 | Perrault et al. | 149/19.4 |
| 4,853,051 | 8/1989 | Bennett et al. | 149/19.4 |
| 4,889,571 | 12/1989 | Willer et al. | 149/19.9 |
| 5,074,938 | 12/1991 | Chi | 149/19.4 |
| 5,120,479 | 6/1992 | Chan et al. | 149/19.92 |
| 5,186,770 | 2/1993 | Adams et al. | 149/92 |

*Primary Examiner*—Edward A. Miller
*Attorney, Agent, or Firm*—Townsend and Townsend and Crew LLP

[57] ABSTRACT

Polybutadiene-compatible, energetic nitrate ester plasticizers of aliphatic hydroxyl compounds, having from 6 to 18 carbon atoms per molecule, and a carbon/nitrate-group ($C/NO_3$) ratio of 3 to 8 are described. The plasticizers allow to reduce the solids content of PBD-propellant compositions, resulting in significantly improved processabilty and, in many instances, also better mechanical properties. The very low viscosity of the uncured propellant binders permits processing and cure at ambient temperature, yielding essentially stress-free grains, thus lessening the danger of grain-cracking and/or propellant insulation debonding during long-term storage. Another benefit of the energetic plasticizers is a substantially reduced cure-rate, making an exceptionally long potlife feasible. Specific impulse, density, and burning rate are slightly increased, while NOL-sleeve detonability remains negative at zero cards. The new binder is particularly useful for totally clean ammonium nitrate oxidized booster propellants.

6 Claims, No Drawings

ENERGETIC PLASTICIZERS FOR POLYBUTADIENE-TYPE SOLID PROPELLANT BINDERS

BACKGROUND OF THE INVENTION

The field of the present invention pertains to energetic polybutadiene-compatible plasticizers for solid propellant binders.

Most of the solid propellant binders in use today are reaction products of hydroxyl terminated polybutadiene prepolymers (HTPBD), such as R45M, (producer: ATOCHEM, North America) with polyisocyanates, such as isophorone diisocyanate (IPDI). The binders are often diluted up to 40% with "inert" plasticizers, such as dioctyladipate (DOA). Inert plasticizers do not carry energetic groups and serve mainly to improve propellant processability and the flexibility at low temperature. The main disadvantage of inert-plasticized PBD-binders is, besides a small loss of performance (impulse), their need of very high levels of oxidizer to effect complete combustion. The correspondingly reduced volume fraction of the binder, which provides the liquid components of the propellant formulation, causes a high viscosity of the propellant slurry, and thus impaired processability and, usually, poor strain capability in the cured propellant. Low binder fractions are particularly prevalent in ammonium nitrate oxidized propellants, because of the lower density of that oxidizer. Here, other binder systems with a lower oxygen demand are used. Typically, polyester and/or polyether prepolymers highly diluted (up to 80%) with "high-energy plasticizers" are employed. The latter are the nitrate esters of glycerol, butanetriol, trimethylolethane, and tri-and diethyleneglycol, or nitro- compounds, such as the formals and/or acetals of 2,2-dinitropropanol, 2,2,2-fluorodinitroethanol, etc. All of these are liquid and belong to the class of "high-explosives". Their principal function is to supply oxygen, at least for their own combustion, while simultaneously providing a low viscosity liquid for improved processability.

Useful, PBD-binder-compatible, energetic plasticizers were neither known nor were they readily available. None of the above mentioned high-energy nitrato- or nitro-compounds is soluble to any significant extent in polybutadiene prepolymers. Even if they were, the disadvantages that they impart, namely a significantly increased detonabilty hazard and a high pressure exponent of the burn rate, would make such systems unattractive for many missions.

Azido-compounds, a type of energetic materials that are now being investigated in the industry, are chemically incompatible with the double bonds of polybutadiene, and therefore can not be employed in such systems. Of the energetic compounds, practically only nitrato-and nitro-derivatives are chemically compatible with polybutadienes.

On the other hand, high-energy-plasticizer-compatible polyesters and polyethers are poorly suited for ammonium nitrate oxidized propellants. Polyesters, because of their hydrolytic instability, which is strongly aggravated by the hygroscopicity of ammonium nitrate, and polyethers, because of their solvating power for ammonium nitrate, which causes very viscous, unprocessable propellant batches. Some energetic prepolymers, like GAP and energetic-group-carrying polyoxetanes could be used with ammonium nitrate. Their disadvantages are a questionable availability in large quantities, and at least with GAP, their notorious unreliability. Their chemical instability, and potential detonability, when plasticized with high-energy nitrate esters, and also inherently high pressure exponents as well as cost make such propellant types unsuitable for large booster rockets.

OBJECTIVES OF THE INVENTION

The objectives of this invention are to provide a low cost, oxygenated PBD-binder system for solid propellants, suitable for large booster rockets, that a) attains optimum performance at lower solids levels than inert-plasticized PBD-binders,
b) is non-detonable,
c) has a low pressure exponent of the burn rate,
d) is particularly well suited for ammonium nitrate oxidized solid propellant types, and
e) renders the same or improved ballistic performance as state-of-art propellants.

SUMMARY OF THE INVENTION

The above objectives are achieved by employing a PBD-binder which is plasticized from 40 to 75 percent (corresponding to a plasticizer to polymer ratio from ⅔ to 3) with PBD-compatible nitrato-derivatives of aliphatic hydrocarbons, having from 6 to 18 carbon atoms, and a ratio of 3 to 8 carbon atoms per nitrato-group. Instead of a single nitrato-compound, mixtures of may be used.

DETAILED DESCRIPTION OF THE INVENTION

The reason for the limitations cited in the summary are that levels of plasticizer less than 40% supply relatively little oxygen to the system, while levels above the upper limit yield binders with too low polymer content, resulting in propellants of unsatisfactory mechanical strength. The second limitation refers to the physical compatibility of the nitrate esters with polybutadiene prepolymers. Physical compatibility means the ability of the nitrate ester to form clear, stable solutions with the liquid, uncured binder components, and, after cure, to yield dry, rubbery materials without evidence of exudation of the plasticizer. The aliphatic nitrate esters of more than 18 carbon atoms are either solids or liquids of low mobility, and thus poor plasticizers, while $C/NO_3$-ratios of less than 4 make the compounds, per se, too insoluble in PBD-prepolymers (see Table 1). However, 2-ethylhexyl nitrate was found to be an excellent cosolvent for the dinitrates of this invention, making even the relatively insoluble dinitratohexanes sufficiently soluble. Furthermore, a 65/35 mixture of octyl nitrate and dinitrato hexane has the same oxygen content as a 50/50 mixture of octyl nitrate with dinitratooctane, thus a higher proportion of the solubilizing ethylhexyl nitrate can be employed. Unfortunately, this method does not work with the more polar high-energy plasticizers. The latters solubility in polybutadiene is not sufficiently increased by the relatively non-polar 2-ethylhexyl nitrate.

Table 1 lists the solubilities of the nitrate ester of this invention with R45M prepolymer. For comparison also included are some of the high-energy plasticizers that are components in some solid propellants. Clearly, nitrate esters with a $C/NO_3$-ratio <4 are too insoluble, per se, in R45M, as demonstrated by the two hexane dinitrates. Even the octane dinitrates, by themselves would be marginal. However, in combination with 2-ethylhexyl nitrate all dinitrates become sufficiently soluble. In the table the solubility is given as parts of nitrato-compound per 100 parts R45M for single compounds and, for the three-component mixtures, as parts of the dinitrate in 100 parts of a 50% solution of R45M in 2-ethylhexyl nitrate.

TABLE 1

SOLUBILITY OF NITRATE ESTERS IN R45M PREPOLYMERS AT 25° C.

| Compound(s) | Solubility (pph) |
|---|---|
| High-energy plasticizers | |
| Nitroglycerin | <1 |
| Butanetriol trinitrate | <1 |
| Trimethylolethane trinitrate | 2 |
| Triethyleneglycol dinitrate | 2.5 |
| Bis-(dinitropropyl) formal | 2 |
| Plasticizers of this invention | |
| 2-Ethylhexyl nitrate | unlimited |
| 2,5-Hexane dinitrate | 13 |
| 1,6-Hexane dinitrate | 8 |
| 2-ethyl-1,3-dinitratohexane | 29 |
| 2,2,4-trimethyl-1,3-dinitratopentane | 28 |
| 2-ethyl-2-butyl-1,3-dinitratopropane | 65 |
| 1,2-Decane dinitrate | 130 |
| Solubility in 1/1 R45M/2-ethylhexyl nitrate | |
| 2,5-Hexane dinitrate | 53 |
| 1,6-Hexane dinitrate | 42 |
| 2-Ethyl-1,3-dinitratohexane | 83 |
| 2,2,4-Trimethyl-1,3-dinitratopentane | 75 |
| 2-Ethyl-2-butyl-1,3-dinitratopropane | 158 |

None of the nitrate esters of this invention is an explosive, nor have they ever been considered as components for solid propellants. However, the compounds have been known for some time, and their preparation and properties may be found in the chemical literature, e.g., in Beilstein, "Handbuch der organischen Chemie". For studying their suitability as PBD-plasticizers they were synthesized by the inventor by nitrating the corresponding hydroxyl derivatives with acetylnitrate. The preparation of 2-ethyl-1,3-dinitratohexane may serve as a general example: To 300 ml (3.2 moles) of acetic anhydride were added, with stirring, 100 ml (2.12 moles) 90% nitric acid at about 20° C. The solution was then cooled to 5° C. and slowly added with vigorous stirring to a solution of 146 grams of 2-ethyl-1,3-hexanediol dissolved in 300 ml of methylene chloride. The temperature was kept between −5° and +5° C. during the addition and for 20 minutes thereafter. The reactant solution was then poured over 500 grams of sodium bicarbonate, followed by the addition of water and very rapid stirring. When the pH of subsequent bicarbonate-water washings remained at 7 to 8, the organic layer was washed with distilled water and dried over magnesium sulfate. After drying the methylene chloride was stripped in vacuum, leaving the desired product as an oily liquid. With the same procedure and the same molar proportion of reactants the other nitrate esters of this invention were obtained.

DESCRIPTION OF THE PREFERRED EMBODIMENT

The preferred binder uses a mixture of octyl nitrate with octane dinitrate. The liquid binder premix includes the PBD-prepolymer, preferred is R45M, R45HT or mixtures of the two prepolymers; the curative, preferred is isophorone diisocyanate; a bonding agent, preferred are neutral bonding agents of the type described by Oberth in "Improved Bonding Agents for HTPB-propellants", Ser. No. 07/473,254 Jan. 1990 (now under secrecy order); stabilizers, such as diphenyl amine; and a cure catalyst, preferred is dibutyltin dilaurate. If the cure catalyst is omitted full cure will take about 2 weeks at ~25° C. The preferred mono nitrate is the inexpensive, commercially produced 2-ethylhexyl nitrate, and for the dinitrate 2-ethyl-1,3-dinitrato hexane or 2,2,4-trimethyl-1,3-dinitrato pentane is preferred. Both have a satisfactory compatibility with R45M, and utilize inexpensive and readily available diol precursors. A candidate is also 1,6-dinitratohexane, primarily because of the low cost of its diol precursor.

Processing of the novel plasticizers in propellant formulations does not markedly differ from handling of conventional inert or high-energy plasticizers, except that the very low vicosity of the uncured mixture of binder constituents allows mixing to be done at ambient (~25° C.) temperature. Otherwise, the methods of processing the propellants are the same as those used in the propellant industry, and are well known to those skilled in the art.

The usefulness of the invention is demontrated by way of specific examples. Table 2 lists the composition and properties of three ammonium perchlorate-oxidized propellants. Propellants A and B make use of the energetic plasticizers of this invention, propellant C is a state-of-the-art HTPBD-propellant. Almost identical results with respect to propellant A are obtained if a 65/35 mixture of 2-ethylhexyl nitrate with 1,6-dinitratohexane is used instead of the plasticizer combination shown in the Table. A disadvantage of the latter combination may be a slightly higher volatility.

TABLE 2

Ammonium Perchlorate-oxidized PBD-Propellants

| | Weight % in Propellant | | |
|---|---|---|---|
| | A | B | C |
| Components | | | |
| Total solids | 83 | 82 | 88 |
| Ammonium perchlorate | 60 | 57 | 68 |
| Aluminum | 23 | 25 | 20 |
| PBD-binder-premix* | 5.67 | 4.50 | 10 |
| 2-ethylhexyl-nitrate | 5.66 | 5.85 | — |
| 2-ethyl-1,3-dinitratohexane | 5.66 | — | — |
| 2,2,4-trimethyl-1,3-dinitratopentane | — | 7.65 | — |
| Inert plasticizer (DOA) | — | — | 2 |
| Mix temperature °C. | 25 | 25 | 57 |
| Properties | | | |
| Standard specific impulse (sec) | 265.3 | 265.2 | 264.5 |
| Burn rate at 70 MPa (mm/sec) | 10.5 | 10.9 | 10.1 |
| Pressure exponent | 0.36 | 0.37 | 0.36 |
| Density (g/ccm) | 1.807 | 1.79 | 1.801 |
| Viscosity (kpoise at 10 kdynes/°C.) | 6/25 | 4/25 | 48/57 |
| Detonability (NOL at 0 cards) | negative | neg. | neg. |
| Volume fraction of binder | 0.271 | 0.312 | 0.238 |

*Propellant A uses R45M; propellant B uses R45HT.

Table 2 shows that the energetic plasticizer increase performance by about 1 second. Inspite of 5–6% less solids and an increased volume fraction of the binder little or no density is lost. The larger volume fraction of liquid constituents, coupled with the much lower viscosity of the highly plasticized composition, results in substantially lower batch-viscosities, allowing processing at ambient temperature with savings in the cost of facilities. At cure-temperatures around 25° C., and omission of cure-catalyst, a potlife of about 36 hours can be obtained. This is considerably more than can be obtained with state-of-the-art propellants. A long potlife is important for large booster rockets that require multiple propellant batches. But, perhaps, even more important is that ambient-temperature cure yields an essentially stress-free grain which minimizes the danger of grain-cracking or propellant/insulation debonds during unavoidable temperature variations on long-term storage. Other important propellant parameters, such as burn rate, pressure exponent and hazard, are not adversely affected by the novel plasticizers.

Especially advantageous are the energetic plasticizers of this invention in ammonium nitrate-oxidized, clean, solid propellants with a PBD-binder. This is clearly brought out by comparing a state-of-the-art propellant with those that can be obtained by this invention: To overcome the processing problems of a high solids, ammonium nitrate oxidized, PBD-propellant, Frosch and Anderson, U.S. Pat. No. 4,158,583 (1979), had to resort to about 2 mm large spherical ammonium nitrate prills. Such large particle sizes of the solid components have a disastrous effect on the cohesive strength and flexibility of the grain. Also needed was a minimum of 10% ammonium perchlorate plus 4% of (toxic) ballistic modifiers (copper and chromium compounds) for the satisfactory combustion of aluminum. Hence, their propellant can not be considered truly "clean". Even with these modifications the propellant did not meet the ballistic requirements of the space shuttle booster, but required additional 15–17% of the high-explosive HMX. Such modifications seriously increase the danger of detonation and are not acceptable for manned missions. Composition and salient properties of this propellant (without HMX) are listed in column #2 of Table 3.

Propellant #1 (of Table 3) is the present, polluting (21% HCl) space shuttle propellant for which non-polluting substitutes are desired. It is included for comparison. Propellant #3 is a "scavenger" type propellant, whose equimolar mixture of ammonium perchlorate and sodium nitrate combines during combustion to harmless sodium chloride. The disadvantage is a substantial loss of performance because of the relatively unenergetic sodium nitrate.

Propellants #4 and #5 use the novel, energetically plasticized PBD-binder of this invention. Their lower solids level yields well processing propellant slurries and improved propellant mechanical properties (see Table 4). Substitution of magnesium metal for aluminum markedly increases burning rate and combustion efficiency. This effect of magnesium in ammonium nitrate oxidized systems has, perhaps, first been reported by Oberth in "Phase Stabilized Ammonium Nitrate for Solid Rocket Propellants", "Phase II" Final Report AL-TR-90-020, Aug. 1990.

As evident from Table 3 only propellants 4 and 5, utilizing the new plasticizers, are totally clean. They also have the best performance of the four clean propellants listed, as well as an acceptable burn rate and pressure exponent without the need of ammonium perchlorate and/or combustion catalysts. They also possess excellent processability and mechanical properties (see Table 4).

TABLE 3

Ammonium Nitrate-Oxidized Clean Booster Propellants

| | Weight % in Propellant No. | | | | |
|---|---|---|---|---|---|
| Components | 1 | 2 | 3 | 4 | 5 |
| Total solids | 86 | 88 | 88 | 85 | 84 |
| Ammonium perchlorate | 70 | 10 | 40 | — | — |
| Ammonium nitrate | — | 59 | — | 59 | 60 |
| Sodium nitrate | — | — | 29 | — | — |
| Aluminum | 16 | 15 | 19 | — | 12 |

TABLE 3-continued

Ammonium Nitrate-Oxidized Clean Booster Propellants

| | Weight % in Propellant No. | | | | |
|---|---|---|---|---|---|
| Components | 1 | 2 | 3 | 4 | 5 |
| Magnesium | — | — | — | 26 | 12 |
| Inert PBD binder | 14 | 12 | 12 | — | — |
| Energetic-PBD binder[a] | — | — | — | 15 | 16 |
| ballistic modifier(s): | | | | | |
| $Fe_2O_3$ | 0.4 | — | — | — | — |
| $CuO_2O_2$ | — | 2 | — | — | — |
| Ammonium dichromate | — | 2 | — | — | — |
| HCl (% of exhaust) | 20.9 | 3 | 1 | 0 | 0 |
| Standard $I_{sp}$ (sec) | 262.3 | 246.8 | 244.5 | 259.5 | 260.5 |
| Density (g/ccm) | 1.77 | 1.62 | 1.87 | 1.58 | 1.63 |
| Vol. fract. binder[b] | N/A | 0.215 | 0.244 | 0.232 | 0.255 |
| burn rate (mm/sec) | 8.1 | 5.3 | 8.1 | 7.9 | 6.9 |
| pressure exponent | 0.46 | 0.28 | 0.40 | 0.34 | 0.27 |
| NOL at 0 cards | neg | neg | neg | neg | neg |
| Viscosity[c] (kpoise) | 87 | 480 | 34 | 35 | 8 |
| Processing-temp. (°C.) | 57 | 57 | 57 | 25 | 25 |

[a]binder composition of propellant A, Table 2.
[b]at 70 MPa.
[c]at 10 kdynes shear stress at processing-temperature.

As a rule, flawless propellant grains are no longer obtained when the viscosity exceeds about 100 kpoise. This usually happens when the volume fraction of the binder drops below about 0.22. Accordingly, propellant #2 was not truly castable and needed excessive vibration to consolidate into a compact mass. Even so, the specimen was not void-free. Propellants 4 and 5 yielded void-free specimens. Their mechanical properties are compared to the state-of-the-art propellant of Frosch and Anderson (#2) in Table 4. Clearly, their mechanical properties, particularly their strain capability, is far superior to the inert plasticized state-of-the-art propellant.

TABLE 4

Tensile Properties of Propellants 2, 4 and 5 of Table 3.

| | Max. stress (MPa)/strain, %/Modulus (MPa) at test-temperature, °C. | | |
|---|---|---|---|
| | 66 | 25 | −40 |
| Propellant 2 | N/A | .45/7/14.3 | N/A |
| Propellant 4 | .61/25/3.6 | 1.01/29/5.2 | 2.32/24/22.4 |
| Propellant 5 | .52/38/2.5 | .92/40/4.0 | 1.98/31/19.9 |

Motor firing data of a 7 lb grain of propellant 4 has shown 89.5% combustion efficiency. This is a good efficiency for a small motor, indicating that the new energetic plasticizers live up to theoretical predictions.

Having described the invention and its preferred embodiments, it is clear that it may be performed in other ways, and with other compounds than those specifically described in the specification without deviating from the spirit of the invention.

I claim:

1. An isocyanate-curable solid propellant composition comprising: an inorganic oxidizer, a metallic fuel, and a polybutadiene binder, wherein the improvement consists of said binder containing polybutadiene-compatible, nitrate ester plasticizers of aliphatic hydroxyl compounds, having hydrocarbon chains from 6 to 18 carbon atoms, and a ratio of 4 to 8 carbon atoms per nitrate group, and where said plasticizers constitute from 40 to 75 percent of the total weight of said binder.

2. A propellant composition according to claim 1 wherein the plasticizer is 1,2-dinitratodecane.

3. A propellant composition according to claim 1 wherein the plasticizer is 2-ethylhexyl nitrate.

4. A propellant composition according to claim 1 wherein the plasticizer is a mixture of 2-ethylhexyl nitrate and 1,6-dinitratohexane.

5. A propellant composition according to claim 1 wherein the plasticizer is a mixture of 2-ethylhexyl nitrate and 2,2,4-trimethyl-1,3-dinitratopentane.

6. A propellant composition according to claim 1 wherein the plasticizer is a mixture of 2-ethylhexyl nitrate and 2-ethyl-1,3-dinitratohexane.

* * * * *